US008782953B2

(12) United States Patent
Bongiovanni

(10) Patent No.: US 8,782,953 B2
(45) Date of Patent: Jul. 22, 2014

(54) DOOR CLOSING DEVICE

(75) Inventor: Claudio Bongiovanni, Verona (IT)

(73) Assignee: Industria Casearia Silvio Belladelli S.R.L., Verona (IT)

( * ) Notice: Subject to any disclaimer, the term of this patent is extended or adjusted under 35 U.S.C. 154(b) by 0 days.

(21) Appl. No.: 13/696,777

(22) PCT Filed: May 11, 2011

(86) PCT No.: PCT/IB2011/052069

§ 371 (c)(1),
(2), (4) Date: Nov. 7, 2012

(87) PCT Pub. No.: WO2011/141880

PCT Pub. Date: Nov. 17, 2011

(65) Prior Publication Data

US 2013/0047512 A1 Feb. 28, 2013

(30) Foreign Application Priority Data

May 11, 2010 (IT) ..... VR2010A0101

(51) Int. Cl.

| | |
|---|---|
| ***E05D 7/06*** | (2006.01) |
| ***E05F 1/12*** | (2006.01) |
| ***E05F 3/20*** | (2006.01) |
| ***E05F 3/12*** | (2006.01) |

(52) U.S. Cl.

CPC ..... *E05F 3/20* (2013.01); *E05Y 2201/20* (2013.01); *E05Y 2900/132* (2013.01); *E05F 1/1223* (2013.01); *E05Y 2201/458* (2013.01); *E05Y 2201/638* (2013.01); *E05Y 2201/234* (2013.01); *E05Y 2201/604* (2013.01); *E05F 3/12* (2013.01); *E05Y 2201/688* (2013.01)

USPC ..... 49/239; 49/237; 16/309

(58) Field of Classification Search

USPC ..... 49/236–239; 16/309, 312, 313, 54, 50

See application file for complete search history.

(56) References Cited

U.S. PATENT DOCUMENTS

| | | | | | |
|---|---|---|---|---|---|
| 424,614 | A * | 4/1890 | Morris | 16/54 |
| 491,898 | A * | 2/1893 | Lowe | 16/54 |
| 1,393,889 | A * | 10/1921 | Franckaerts | 16/54 |
| 1,423,784 | A * | 7/1922 | Vuille | 16/55 |
| 4,358,870 | A * | 11/1982 | Hong | 16/53 |
| 4,485,522 | A * | 12/1984 | Chen | 16/54 |
| 5,133,152 | A * | 7/1992 | Grancagnolo | 49/239 |
| 7,155,776 | B2 * | 1/2007 | Park | 16/50 |
| 7,966,693 | B2 * | 6/2011 | Choi et al. | 16/54 |

OTHER PUBLICATIONS

International Search Report for PCT/IB2011/052069.

* cited by examiner

*Primary Examiner* — Katherine Mitchell
*Assistant Examiner* — Scott Denion
(74) *Attorney, Agent, or Firm* — Notaro, Michalos & Zaccaria P.C.

(57) ABSTRACT

A door closing device (10) for an automatic closing of a door leaf (B) coupled with a floor and/or a doorpost (S) so as to swing. The door closing device (10) comprises a fixed unit (12) that is fixed on the floor and/or the doorpost (S), a translating unit (14) and a rotating unit (16) on which the door leaf (B) is fixed. The coupling of the three units (12, 14, 16) and the presence of spring (38) are such that, when the rotating unit (16) rotates in a first sense of rotation, the translating unit (14) is caused to translate in a direction and such that, when the translating unit (14) translates in an opposite direction, the rotating unit (16) is caused to rotate in an opposite sense of rotation.

7 Claims, 9 Drawing Sheets

DOOR CLOSING DEVICE

The present invention refers to a door closing device, namely an automatic closing device for doors, windows, etc. More specifically, it is a device designed to be applied to hinged doors preferably, but also to shutters, cabinet doors, hatches and the like, wherever there is a hinged door, in order to achieve the automatic closing of the door leaf.

As is general knowledge there are door closing devices designed to automatically close hinged doors. They are, in fact, commonly used as door closing devices with moveable arms, such as in aircraft or aerodynamic door closers; push door closers are also used, or devices recessed into the profile of the door, also known as concealed door closers, or devices that, for their application and function, must be planted in the ground near the door, given the considerable complexity and proportions of the elements they contain.

These devices are therefore bulky and unsightly, as in the case of mobile arm devices, and are impractical and problematic in terms of installation; in the case of concealed or planted devices, it is clear that the inconvenience is created by having to prepare an area that is suitable to contain such closing devices.

The purpose of this invention is to offer a door closing device that is practical to assemble and easy to use.

A further purpose of the invention is to achieve a door closer that is not bulky and unsightly.

Yet another purpose of the invention is to achieve a door closer that is not particularly subject to wear.

These aims and advantages are achieved, according to the invention, by a door closing device for the automatic closing of a hinged door that is coupled so as to rotate to a floor and/or a doorpost around which the hinged door may rotate, comprising a fixed unit that is fixed to the floor and/or the doorpost, a translating unit coupled to the fixed unit so as to move, and a rotating unit which the door leaf is attached to. The translating unit comprises elastic means and at least one wheel connected to the translating unit so as to rotate, with the axis of rotation being perpendicular to the direction of translation of the translating unit. The rotating unit comprises a fixed element that is integral to the rotating unit, and at least one body having an inclined surface in respect to the direction of the translating unit.

In particular, the rotating unit is coupled to the translating unit so that the wheel can run along the inclined surface of the body, so that, in a first sense of rotation the rotating unit, meaning in the direction that the door opens, the movement of the wheel causes a translation of the translating unit in a first direction, with a subsequent compression of the elastic means against the fixed element. When the door leaf is released the expansion of the elastic means causes a translation in an opposite direction of the translating group, causing a reverse rotation in respect to the first sense of rotation of the rotating unit and the door leaf fixed thereon, causing it to close.

Thanks to the door closing device according to this invention, all one needs to do therefore is open the door leaf, thus acting on the elastic means and causing the closure of the door leaf itself, once it has been released.

Advantageously the door closing according to this invention may include a rotating unit comprising a first cam having an inclined surface and fixed on at least one body, through a hole, and wherein the translating unit comprises a pin which passes through the through-hole and to which the wheel is connected so as to rotate; a second cam having an inclined surface is fixed on said pin, the direction of inclination of said cam being the same as the first cam, so that the inclined surface of the first cam can stop against the inclined surface of the second cam. The interaction between the first and second cam creates a braking effect during the closing phase of the door.

In addition, the elastic means may comprise a spring winded up on the pin, making the door closing device more compact. One end of said spring may be fixed on said pin and the opposite end of said spring stopping against the fixed element of the fixed unit.

Advantageously, the coupling between the fixed unit and the translating unit and the movement of said translating unit is achieved without causing any particular friction. In fact, the fixed unit can comprise a shaft in which at least a first vertical seat is obtained and wherein the pin is fixed under a cylindrical body in which a blind hole is obtained; at least a second seat is obtained in the surface forming said blind hole. The shaft is received, at least partially, in the blind hole so that at least a first seat is arranged so as to correspond with at least a second seat and at least a ball is received in said first seat and in said seat at least a second seat, said seats corresponding with each other, so that the cylindrical body can translate and can not rotate in respect to said shaft.

The speed of rotation of the rotating unit and therefore the translation speed of the translation unit may be adjusted thanks to the use of a piston. A hollow cylindrical structural closed on the upper and lower parts is fixed on the rotating unit, in which cylindrical structural the translating unit can translate and with which the fixed unit is coupled so as to rotate. The piston may be arranged in said cylindrical structural so that the inner volume of the cylindrical structural is divided into a lower chamber and an upper chamber for the containment of a fluid. In particular, in said piston and/or cylindrical structural a duct can be obtained for the exchange of fluid between the lower chamber and the upper chamber; and said piston is coupled with said translating unit so that a translation of the translating unit causes a corresponding translation of the piston.

In this way, the translation of the group is also controlled by the rate of flow between the upper and lower chamber.

Advantageously, the top part of the piston can be connected through elastic means with the upper end of the cylindrical structural, and the bottom part of the piston beats against the upper end of the pin. In this way the piston is not connected to the pin and its movement can be led by the spring without particular wear and without problems related to thermal excursions of the fluid inside the chambers.

A further advantage of the invention is the fact that at least one duct for the exchange of fluid between the lower chamber and the upper chamber comprises an adjustable valve to vary the flow of fluid between the lower chamber and the upper chamber. It is possible to adjust the flow rate of the fluid and thus adjust the speed of rotation of the door leaf, particularly in the closing phase.

At least one cross duct can be obtained in the piston and comprises a non-return valve so as to allow the passage of fluid only from the lower chamber to the upper chamber, and wherein at least one vertical duct is obtained in the cylindrical structural for the passage of fluid from the upper chamber to the lower chamber; in particular, the adjustable valve can be disposed in said vertical duct to regulate the speed of translation of the translating unit during the closing phase of the door leaf.

Advantageously, the closing speed of the door leaf can be adjusted according to the position of the door leaf. In fact, a first vertical duct and a second vertical duct are obtained in the cylindrical structural for the passage of fluid from the upper chamber to the lower chamber. The first vertical duct being connected through a first horizontal duct with the lower chamber, the second vertical duct being connected through a second horizontal duct with the lower chamber, in particular the first horizontal duct can be obtained in the cylindrical structural at a lower height than the second horizontal duct obtained in the cylindrical structural; the presence of two connecting ducts at different heights allows the flow of fluid to vary according to the position of the piston and therefore according to the position of the rotating unit.

In addition, the ducts inside the piston and the cylindrical structural can be arranged differently, with the implementation of a single control valve. In fact, a vertical duct can be obtained in the cylindrical structural for the passage of fluid between the upper chamber and the lower chamber, having at least one ball provided in said cylindrical structural at least one vertical duct acting as a non-return valve so as to allow the passage of fluid only from the lower chamber to the upper chamber. An elusion duct can be obtained in the upper portion of the cylindrical structural to connect the upper chamber with at least one vertical duct so as to elude ball and to allow the passage of fluid only from the upper chamber to the lower chamber. An adjustable valve can be included in said elusion duct to obstruct, in a controlled way, the flow of fluid in the elusion duct, and subsequently the rotation speed of the rotating unit during the closing phase of the door leaf.

Further features and details of the invention may be better understood from the following description, provided by way of example without limitation, and from the attached design drawings in which:

FIG. 1 provides an axonometric view of a door leaf attached to a doorpost with a door closing device, a the invention;

FIG. 2 provides a sectional side view of the door closing device of FIG. 1;

Figure 1:
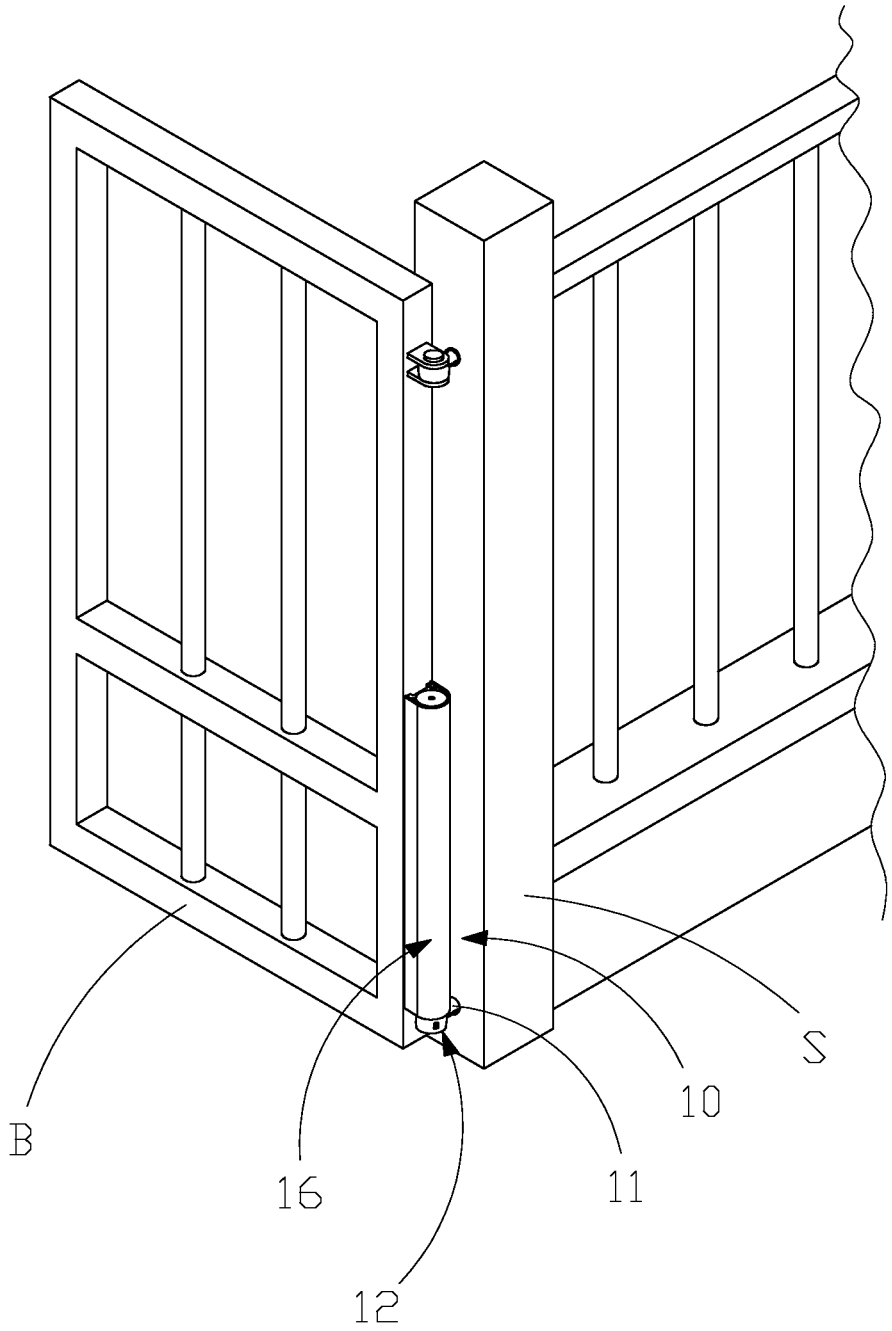

With reference to the attached figures, in particular to FIG. 1, number 10 indicates a door closing device comprising a rotating unit 16 connected to door leaf B, and a fixed unit 12 secured by a locking pin 11 to the doorpost S of a doorway.

Figure 2:
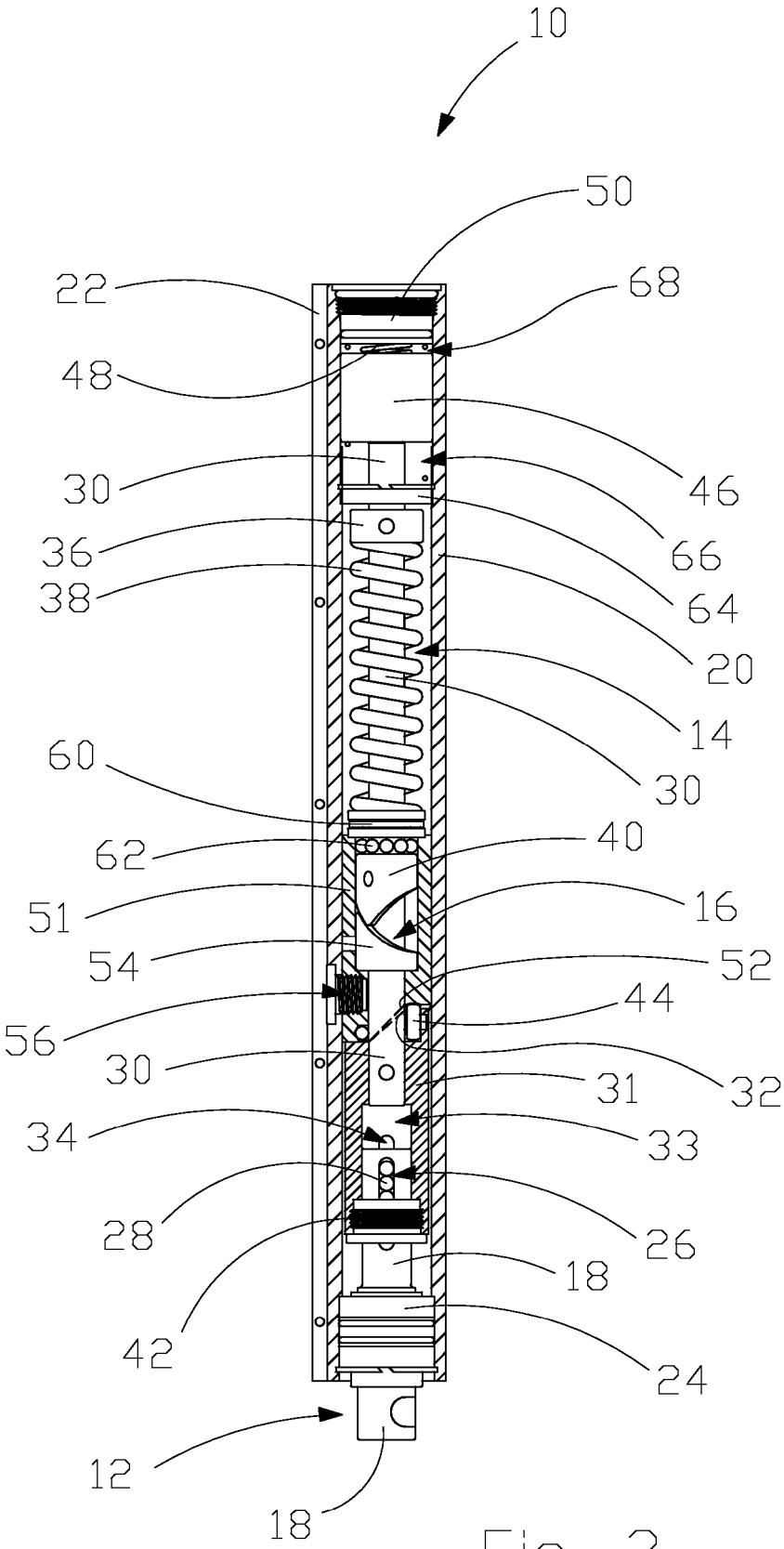

As shown in FIG. 2, the door closing device 10 also comprises a translating unit 14; the interaction between the translating unit 14 and the rotating unit 16, together with the fixed unit 12, allows the automatic closing of the door leaf B, fixed to the rotating unit 16, once said door leaf B has been opened, that is to say, once the rotating unit 16 has been made to rotate.

Figure 3:
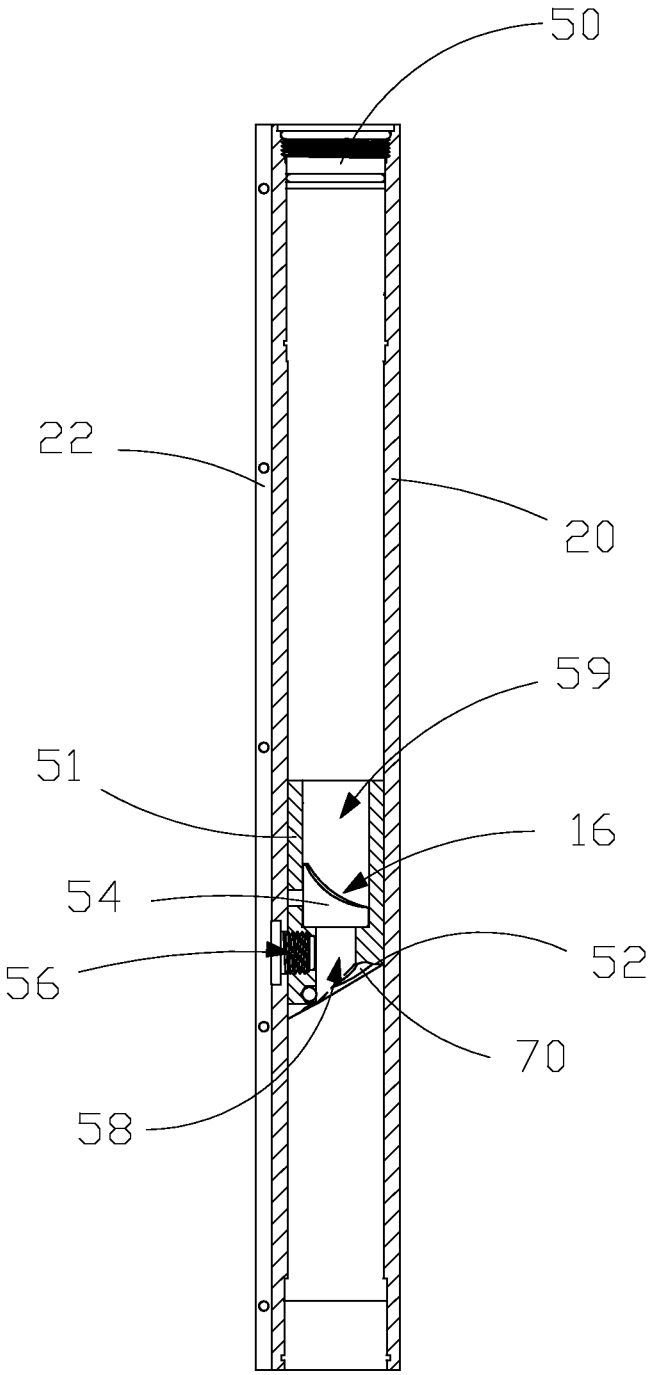
FIGS. 3, 4, 5 are sectional side views of three respective groups of components comprised in the door closing device of FIG. 1.

The rotating unit 16, shown individually in FIG. 3, comprises a rotating cylindrical body 51 terminating in an inclined surface that forms a rotating cam 52. A radial path 70 is obtained in the inclined surface of the rotating cam 52.

At the top of the rotating cylindrical body 51 a top through-hole 59 has been obtained, and at the bottom of said body also a bottom through-hole 58, whose diameter is less than that of the top hole 59.

Inside the top through-hole 59 and fixed to the bottom of said hole is an internally perforated rotating camshaft 54 having an inclined top surface.

The cylindrical rotating body 51 is accordingly fixed to an outer cylindrical structural 20 which is closed at the top with a cap 50. In the outer cylindrical structural 20 and the rotating cylindrical body 51 an orthogonal threaded hole 56 is obtained to accommodate a fixing screw for the rotating unit 16 and the rotating cylindrical body 51 to secure the rotating cylindrical body 51 and the rotating unit 16 to the outer cylindrical structural 20. Furthermore, the outer cylindrical structural 20 includes a groove 22 which connects said outer cylindrical structural 20 to door leaf B, via a plate 23 shown in FIG. 10, which comprises a number of holes 25 and which is fixed to door leaf B with screws inserted into said holes 25. The outer cylindrical structural 20 thus receives the plate 23 in its groove 22, and said plate is later fixed to the outer cylindrical structural 20 with screws 27, so as not to create undesirable spaces or gaps.

Figure 5:
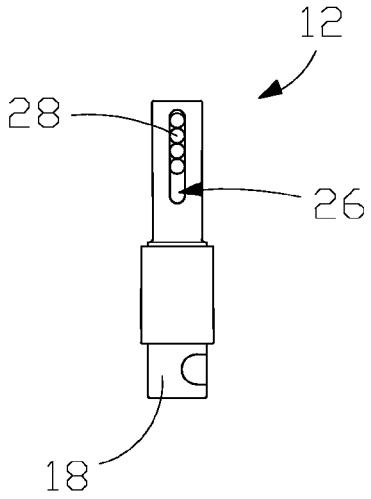

The fixed unit 12, shown individually in FIG. 5, comprises a fixed pin 18 designed to be fixed to the locking pin 11 so as to make it integral to the doorpost S. In the fixed pin 18, vertical seats 26 are obtained for the movement of the balls 28.

As shown in FIG. 2, the fixed pin 18 is connected to the outer cylindrical structural 20 so as to rotate via two bearings 24, so that the outer cylindrical structural 20, and consequently the rotating unit 16, can rotate in respect to the fixed pin 18, and therefore in respect to the fixed group 12.

Figure 4:
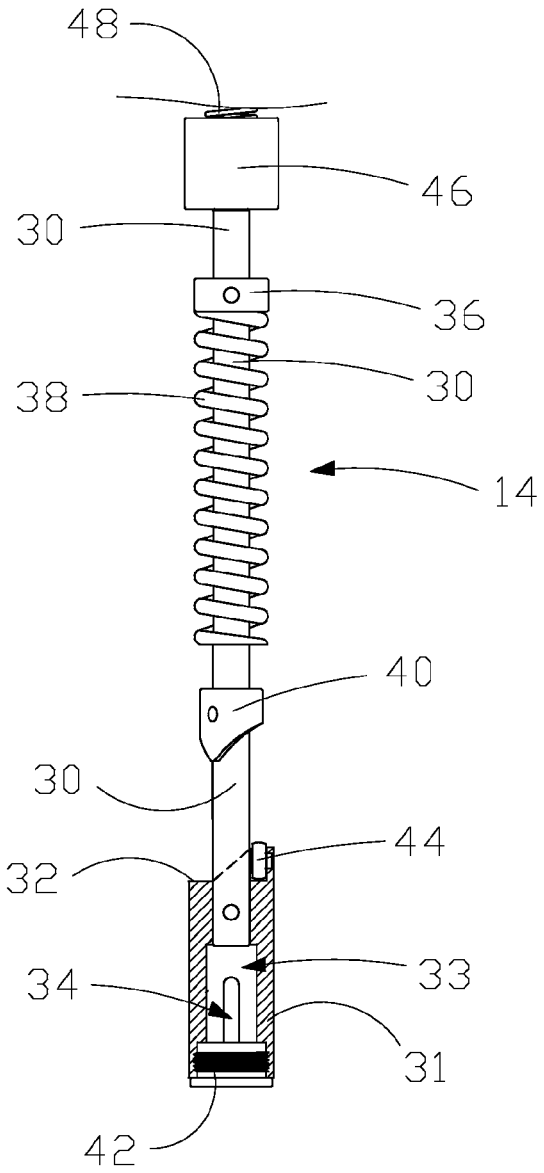

The translating unit 14, shown individually in FIG. 4, comprises a translating pin 30 having a cylindrical translating body 31 fixed to the bottom of said pin, and at the bottom of said body a cylindrical hollow is obtained 33. Vertical seats 34 are obtained on the inner surface of the cylindrical translating body 31 which defines the cylindrical hollow 33, and are equal in number to the vertical seats 26 of the fixed pin 18. The cylindrical hollow 33 is closed at the bottom by a threaded bushing 42, which also has a hole through its centre.

The top of the cylindrical translating body 31 is an inclined surface so as to form a translating cam 32, having substantially the same inclination as that of the inclined surface of the rotating cam 52.

A radial rotating roller 44 is also connected to the translating cam 32 so as to rotate, having an axis of rotation that is perpendicular to the axis of the translating pin 30.

A translating camshaft 40, the bottom surface of which is inclined, is fixed half way up the translating pin 30.

The top portion of the translating pin 30 is fixed to a locking disk 36, the bottom of which is in turn fixed to a spring 38.

As shown in FIG. 2, the door closing device 10 is designed for the assembly and coaxial arrangement of the fixed unit 12, of the translating unit 14 and the rotating unit 16.

In particular, in addition to the coupling between the fixed unit 12 and the rotating unit 16 via bearings 24, so that the rotating unit 16 can rotate with respect to the fixed unit 12, the translating unit 14 is connected to the fixed unit 12 so as to translate: the top portion of the fixed pin 18 fits into the cylindrical hollow 33 of the same shape so that the vertical seats 26 of the fixed pin 18 are positioned in correspondence with the vertical seats 34 of the cylindrical hollow 33 of the translating cylindrical body 31, and at the same time the balls 28 can be received in the vertical seats 34 and in the vertical seats 26.

Due to the configuration of this coupling between the fixed unit 12 and the translating unit 14, said translating unit 14 can only translate and not rotate with respect to the fixed unit 12.

The rotating unit 16 is also coupled with the translating unit 14, the former acting as a cam and the latter acting as the conveyor, so that each rotation of the rotating unit 16 corresponds to a translation of the translating unit 14.

In particular, the rotating cylindrical body 51 is positioned above the translating cylindrical body 31 so that the rotating cam 52 is adjacent to the translating cam 32, and that the radial roller 44 can move through the radial path 70.

In addition, the translating cam bushing 40 fits into the top through-hole 59 so that the inclined surface thereof is adjacent to the inclined surface of the rotating cam bushing 54, so that the two bushings 40, 54 can interact, acting as the brake and end stop.

Above the translating cam bushing 40, around the translating pin 30, a bearing 60 and balls 62 are arranged so as to make the rotating movement of the rotating unit 16 smooth with respect to the translating unit. The bottom of the spring 38 stops against the bearing 60.

Moreover, a fixed disk 64 is fixed inside the top portion of the outer cylindrical structural 20, and in the centre of said disk a through-hole is obtained to receive the translating pin 30.

Above the translating pin 30, inside the outer cylindrical structural 20, there is a piston 46. A spring 48 is disposed between the cap 50 and the piston 46 which also translates while the door closing device 10 is in use.

Between the fixed disk 64 and the piston 46 a lower chamber is created 66, while between the piston 46 and the cap 50 an upper chamber is defined 68. The two chambers 66, 68 are filled with oil which upon the translation of the piston 46 in the outer cylindrical structural 20 is exchanged between said chambers 66, 68 through ducts obtained in said piston 46 and in the upper portion of the outer cylindrical structural 20, as described below.

Figure 6:
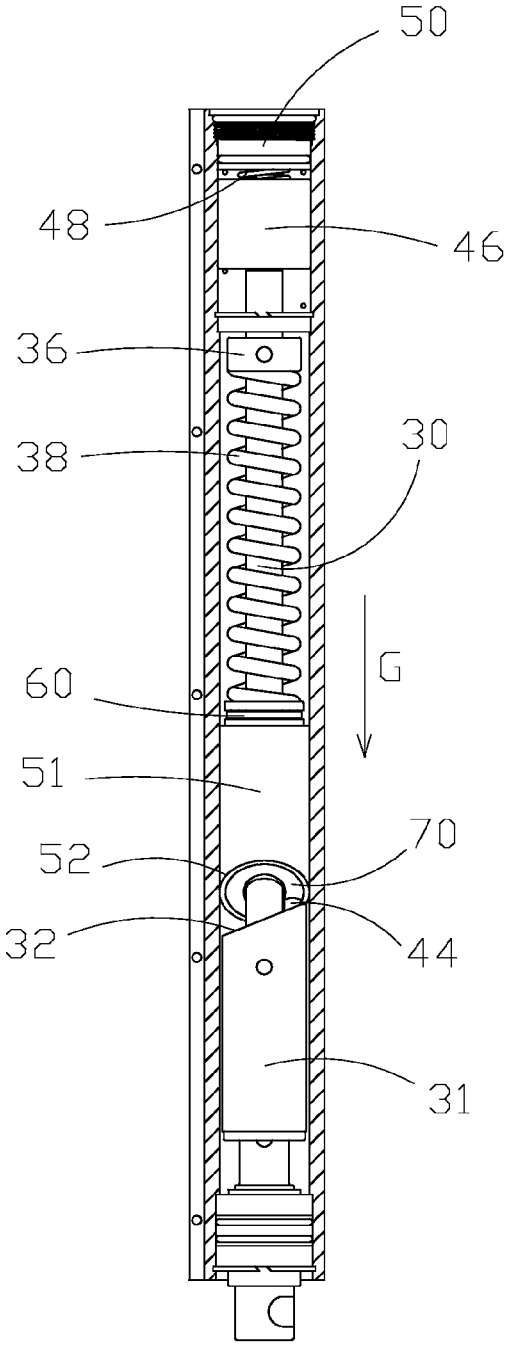
FIG. 6 is a sectional side view of the door closing device of FIG. 1, when in motion.
Figure 7:
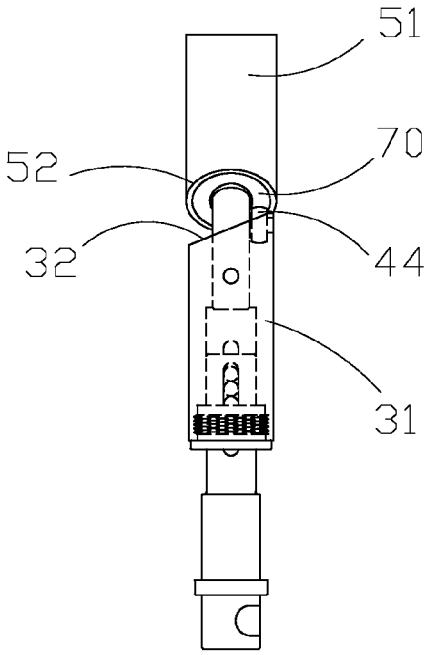
FIGS. 7, 8 are respectively a side view and an axonometric view of a detail from FIG. 6.
Figure 8:
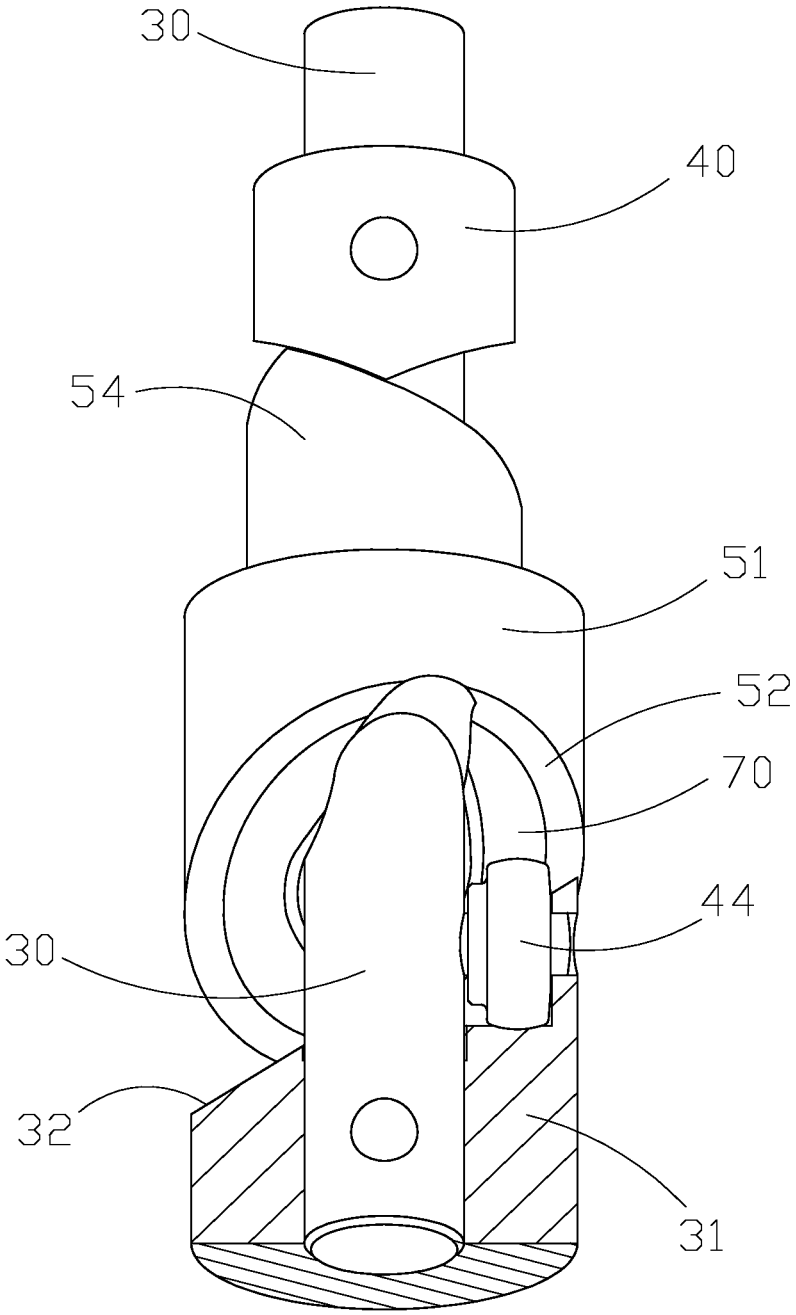

As in FIGS. 6, 7, 8, the translation of the translating unit 14 caused by a rotation of the rotating unit 16 is obtained when the door leaf B is being opened. The rotating unit 16 is rotated by the opening of the door leaf B, the rotating cylindrical body 51 rotates making the rotating cam 52 connected to it cause a downwards movement of the translating cylindrical body 31 and the translating cam 32 which is connected to said cylindrical body, in particular the interaction between the two cams 32, 52 is due to the rolling action of the radial roller 44, pivoting so as to rotate on the translating cam 32, through the radial path 70 obtained on the lower surface of the rotating cam 52.

The rotation of the translating cam 32, and the entire translating unit 14, is prevented by the coupling, described above, disposed between said translating unit 14 and the fixed unit 12.

The downward movement of the translating cam 32 and the translating cylindrical body 31 causes the analogous downward movement, according to the direction indicated by G in FIG. 6, of the translating pin 30 and the locking disk 36 which is connected to it. The spring 38 is thus compressed between the locking disk 36, which translates downwards, and the bearing 60.

At the same time the piston 46 can translate downwards urged by the spring 48 which stops against the cap 50.

When the door leaf B, once it is rotated by the user, is released, the compressed spring 38, being an elastic means, urges the locking disk 36 upwards and, hence the translating pin 30 and all elements connected to it. As shown in FIG. 8, the translating cam 32 translates upwards, forcing the rotating cam 52 to rotate, causing the rotation of the entire rotating unit 16 in that same sense of rotation, that is to say in the opposite direction with respect to the opening of the door leaf B, causing said leaf to close.

In addition, the rotating cam bushing 54 stops against the translating cam bushing 40 which acts as a brake during the closing of the door leaf B.

The closing speed of door leaf B, that is to say the rotational speed of the rotating unit 16 in the sense of returning to its resting position, is controlled by the flow of oil from the upper chamber 68 to the lower chamber 66.

In fact, when the door leaf is opened, the distance between the fixed disk 64 and the piston 46 decreases, and the distance between the piston 46 and the cap 50 increases. The lower chamber 66 decreases in volume, while the upper chamber 68 increases in volume.

Figure 9:
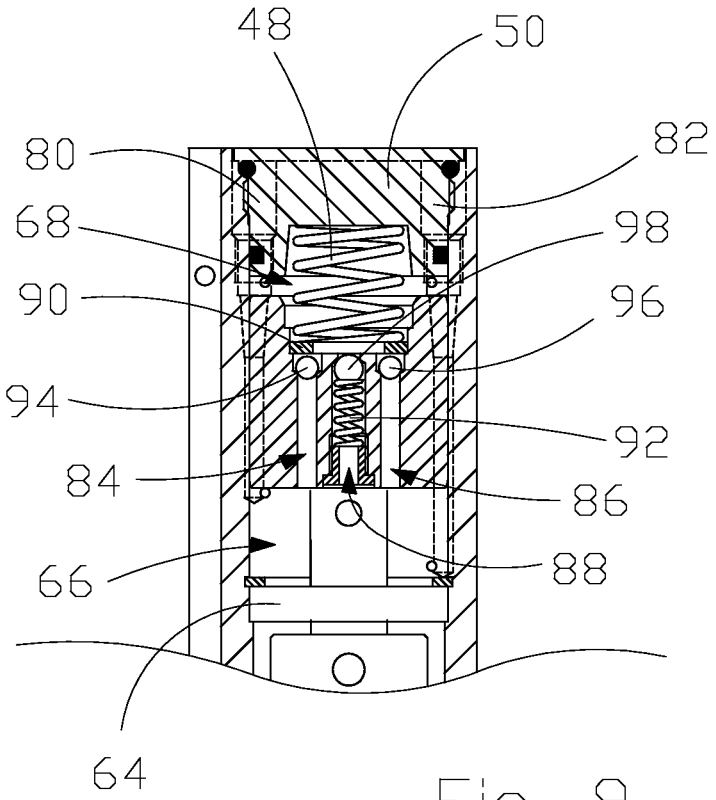
FIG. 9 is a sectional side view of a detail of a door closing device, as per the invention.

The oil is thus forced to move from the lower chamber 66 to the upper chamber 68 through the internal ducts 84, 86, as shown in FIG. 9, with the closing balls 94, 96 which stop against a locking washer 90, leaving ducts 84, 86 unblocked. On the contrary, a central duct 88 is closed by a central closing ball 98 which is urged towards the narrow portion of said central duct 88 also by a spring 92.

The central duct 88, together with the spring 92 and the central closing ball 98, acts as an excess pressure valve: in case of an overload of pressure due to a push during the closing phase, the oil flows through the duct 88 in the lower chamber 66.

During the closing phase, the oil flows from the upper chamber 68 to the lower chamber 66, passing through a first vertical duct 72, while the internal ducts 84, 86 are blocked by the closing balls 94, 96, acting as non-return valves, and are therefore closed.

Figure 11:
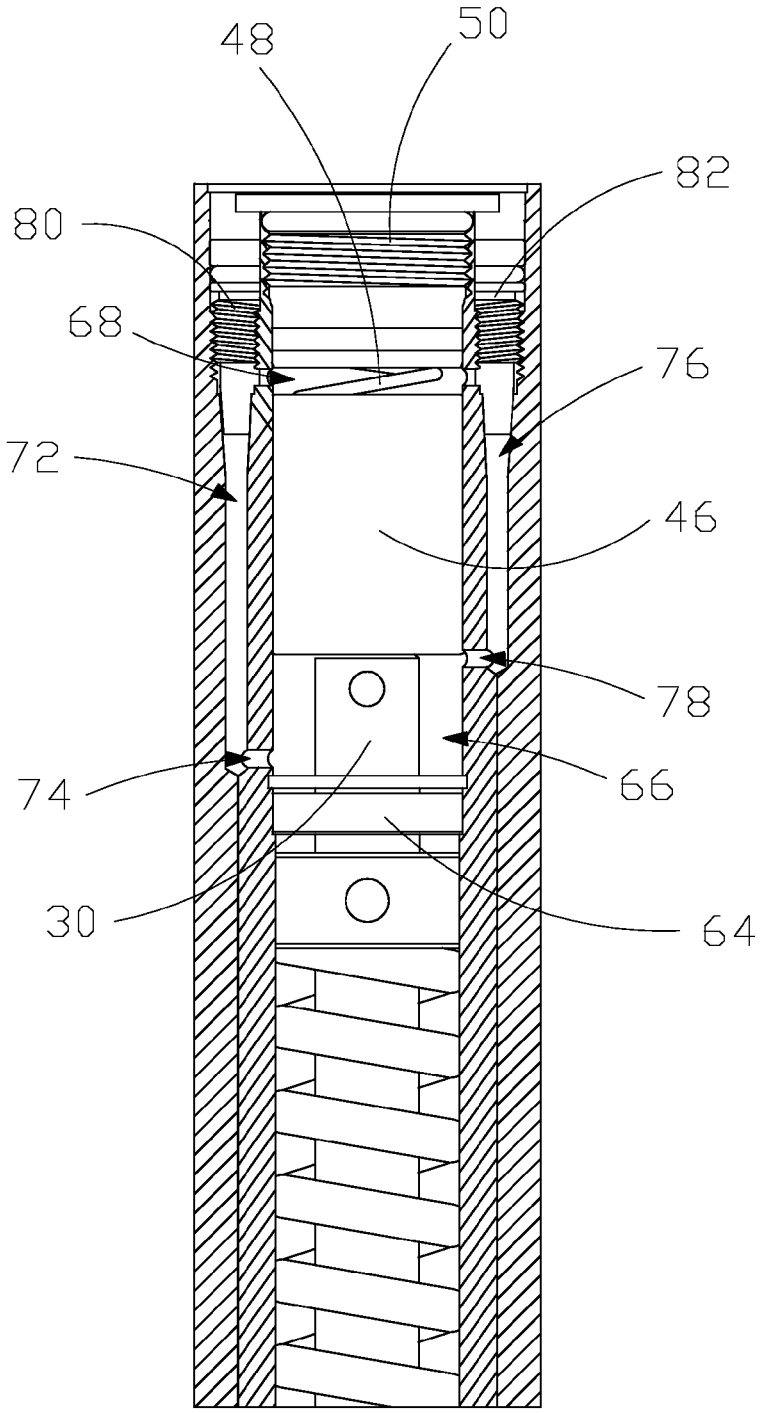
FIG. 11 is a side view from a different section plane of the detail from FIG. 9.

As shown in FIG. 11, the flow of oil between the lower chamber 66 and the upper chamber 68 is facilitated by the connection obtained with the first vertical duct 72, the top end of which is connected to the upper chamber 68 and the bottom end of which is connected to the lower chamber 66 with a first horizontal connection 74, and a second vertical duct 76 the top end of which is connected to the upper chamber 68 and the bottom end of which is connected to the lower chamber 66 with a second horizontal connection 78.

In particular, the first horizontal connection 74 is at a lower height than the second horizontal connection 78, as shown in FIG. 11.

A first vertical valve 80 is screwed into the top of the first vertical duct 72. Analogously, a second vertical valve 82 is screwed into the top of the second vertical duct 76.

Figure 10:
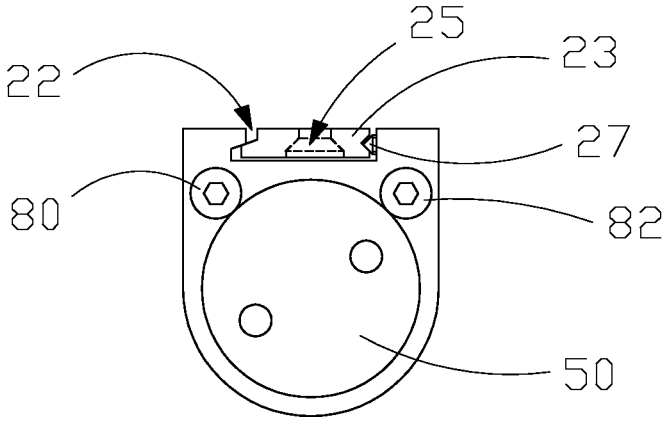
FIG. 10 is a top view of the door closing device from FIG. 1.

The two vertical valves 80, 82, accessible from the top of the cap 50, as shown in FIG. 10, may be screwed more or less tightly into the two vertical ducts 72, 76, thus blocking the respective connections between said vertical ducts 72, 76 with the upper chamber 68 so as to be adjustable.

The first vertical duct 72 causes the door leaf B to close, controlled by the vertical valve 80, while the second vertical duct 76 causes the final closing movement controlled by the vertical valve 82 over the last degrees of closure.

With this configuration of the top part of the door closing device 10, that is to say of the piston 46, the presence of the spring 92 in the central duct 88 and the vertical ducts 72, 76, the rotation of the rotating unit 16 during the closing phase of the door leaf B is slowed down.

Furthermore, the speed of return of said rotating unit 16, and therefore of door leaf B can be adjusted via the two vertical valves 80, 82.

Figure 12:
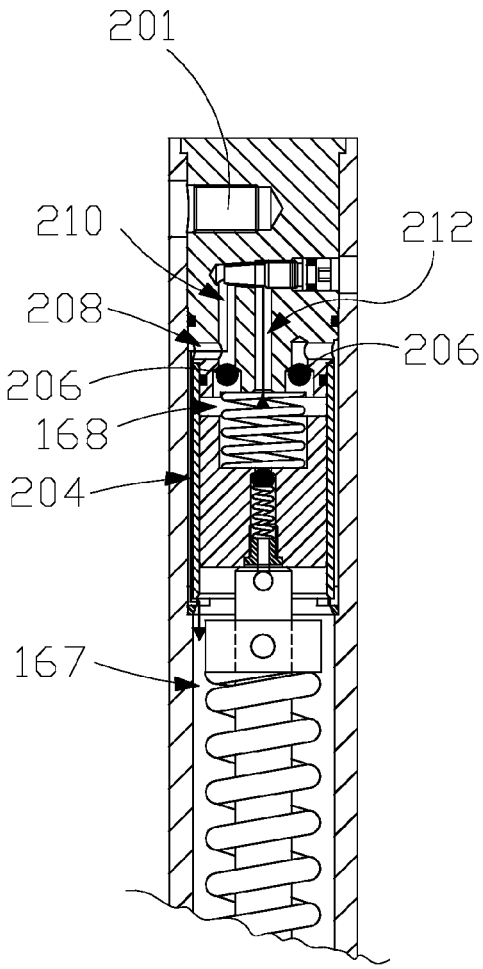
FIGS. 12, 13 are sectional side views of the door closing device based on a different configuration.
Figure 13:
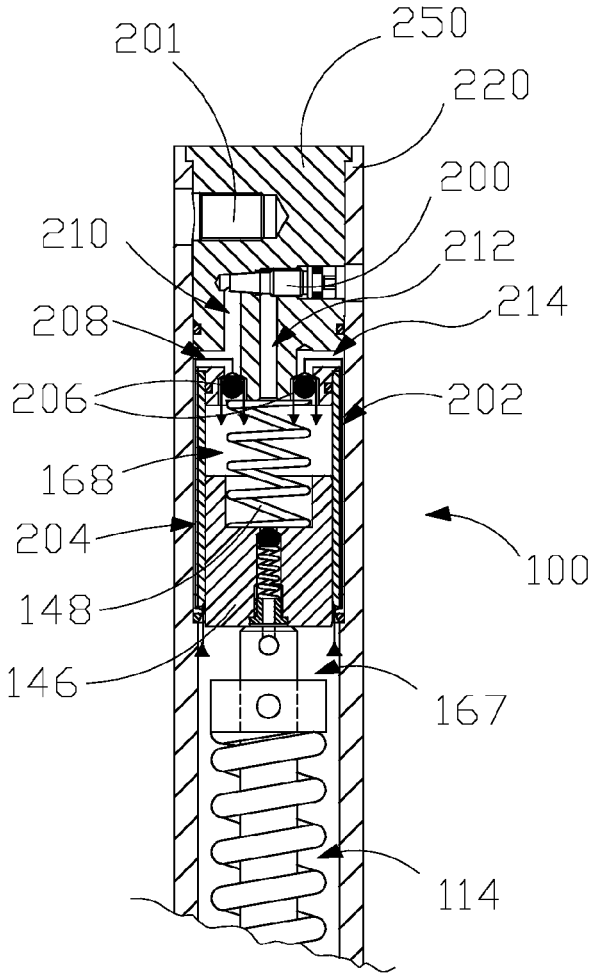

According to a second mode of implementing the invention, as shown in FIGS. 12, 13, a door closing device 100 can comprise an upper portion with ducts and a differently arranged piston 146.

The door leaf is fixed to the door closing device 100 also through a pin screwed into an upper seat 201.

FIGS. 12, 13 illustrate the flow of oil when the device 100 is respectively in the closing phase and opening phase. Said figures only illustrate the upper portion of the door closing device 100, being that the central and lower parts are the same as those of the door closing device 10 described above.

The upper portion of the device 100 comprises a first lateral duct 202 and a second lateral duct 204 obtained in the outer cylindrical structural 220. The two lateral ducts 202, 204 connect an upper chamber 168 obtained between the piston 146 and a cap 250 to a lower chamber 167 where the translating unit 114 translates.

The first lateral duct 202 is connected to the upper chamber 168 through a first horizontal duct 214 blocked by a ball 206 acting as a non-return valve. Analogously, the second lateral duct 204 is connected to the upper chamber 168 through a second horizontal duct 208 also blocked by a ball 206 acting as a non-return valve.

Furthermore, the second horizontal duct 208 is connected to the upper chamber 168 through a first duct 210 and a second duct 212 which are interconnected at the top by a horizontal duct. A horizontal valve 200 fits into the horizontal duct 200, and depending on how tight said valve is screwed into said duct, it blocks the flow between the two ducts 210, 212.

When in use, during the opening phase of the door leaf B, as shown in FIG. 13, the piston 146 translates downwards and the oil is forced to flow from the lower chamber 167 to the upper chamber 168 through the two lateral ducts 202, 204 and the two horizontal ducts 208, 214. The two balls 206 do not impede the passage of oil from the two horizontal ducts 208, 214 to the upper chamber 168.

During the closing phase of door leaf B, as shown in FIG. 12, the piston 146 translates upwards and the oil is forced to flow from the upper chamber 168 to lower chamber 167. The two balls 206 act as non-return valves, and therefore the oil is forced to flow through, in succession, the second duct 212, the horizontal duct, the first duct 210, the second horizontal duct 208 and the second lateral duct 204.

Similarly, as in the first mode of implementation, the rotational speed during the closing phase is controlled by the horizontal valve 200 so that it can block the flow of oil in the horizontal duct at greater or lesser degrees.

Further variants and modes of implementation are possible, and must be considered within the ambit of protection defined by the following claims.

The invention claimed is:

1. A door closing device (10) for an automatic closing of a door leaf (B) coupled with a floor and a doorpost (S) so as to swing, characterized in that the door closing device comprises:

a fixed unit (12) that is fixed on the floor and the doorpost (S);

a translating unit (14) that is coupled with the fixed unit (12) so as to translate and comprises a first spring (38) and at least a wheel (44) connected with the translating unit so as to rotate, the axis of rotation of said wheel (44) being perpendicular to the direction of translation of the translating unit (14);

a rotating unit (16) on which the door leaf (B) is fixed and comprises a fixed element (60) that is integral with the rotating unit, and at least a body (51) having an inclined surface (52) in respect to the direction of translation of the translating unit (14); said rotating unit (16) is coupled with the translating unit (14) so that the wheel (44) can run along the inclined surface (52) of the body (51) and on rotating in a first sense of rotation the rotating unit (16) the running of the wheel (44) causes a translation of the translating unit (14) and a compression of the first spring (38) against the fixed element (60); an expansion of said first spring (38) causes a reverse rotation in respect to the first sense of rotation of the rotating unit (16) and door leaf fixed thereon;

wherein the rotating unit (16) comprises a first cam (54) having an inclined surface and fixed on the body (51), a through-hole (58, 59) being obtained in said body (51), and wherein the translating unit (14) comprises a pin (30) which passes through the through-hole (58, 59) and with which the wheel (44) is connected so as to rotate; a second cam (40) having an inclined surface is fixed on said pin (30), the direction of inclination of said second cam being the same as the one of the first cam (54), so that the inclined surface of the first cam (54) can beat against the inclined surface of the second cam (40);

wherein a hollow cylindrical structure (20), closed on the upper and lower parts, is fixed on the rotating unit (16), in which cylindrical structure (20) the translating unit (14) can translate and with which the fixed unit (12) is coupled so as to rotate, and a translating piston (46) is arranged in said cylindrical structure (20) so that the inner volume of the cylindrical structure (20) is divided into a lower chamber (66) and an upper chamber (68) for the containment of a fluid; at least a duct (72, 74, 76, 78, 84, 86) is obtained in said piston or cylindrical structure (20) for the exchange of fluid between the lower chamber (66) and the upper chamber (68); and said piston (46) is coupled with said translating unit (14) so that a translation of the translating unit (14) causes a corresponding translation of the piston (46); and wherein on the upper part, the piston (46) is connected through a second spring (48) with the upper end of the cylindrical structure (20) and on the lower part, the piston (46) beats against the upper end of the pin (30).

2. The door closing device (10) according to claim 1, wherein the first spring (38), is wound up on the pin (30), an end of said spring (38) being fixed on said pin (30), the opposite end of said spring (38) being beaten against the fixed element (60).

3. The door closing device (10) according to claim 2, wherein the fixed unit (12) comprises a shaft (18) in which at least a first vertical seat (26) is obtained and wherein the pin (30) is fixed under a cylindrical body (31) in which a blind hole (33) is obtained; at least a second seat (34) is obtained in the surface forming said blind hole (33); the shaft (18) is received, at least partially, in the blind hole (33) so that the at least a first seat (26) is arranged so as to correspond with the at least a second seat (34) and at least a ball (28) is received in said first seat (26) and in said at least a second seat (34), said seats corresponding with each other, so that the cylindrical body (31) can translate and can not rotate in respect to said shaft (18).

4. The door closing device (10) according to claim 1, wherein the at least a duct (72, 74, 76, 78, 84, 86) for the exchange of fluid between the lower chamber (66) and the upper chamber (68) comprises an adjustable valve (80, 82) to vary the flow of fluid between the lower chamber (66) and the upper chamber (68).

5. The door closing device (10) according to claim 4, wherein at least a cross duct (84, 86) is obtained in the piston (46) and comprises a nonreturn valve so as to allow the passage of fluid only from the lower chamber (66) to the upper chamber (68), and wherein at least a vertical duct (72, 76) is obtained in the cylindrical structure (20) for the passage of fluid from the upper chamber (68) to the lower chamber (66), said at least an adjustable valve (80, 82) being arranged in said at least a vertical duct (72, 76).

6. The door closing device (10) according to claim 4, wherein a first vertical duct (72) and a second vertical duct (76) are obtained in the cylindrical structure (20) for the passage of fluid from the upper chamber (68) to the lower chamber (66), the first vertical duct (72) being connected through a first horizontal duct (74) with the lower chamber (66), the second vertical duct (76) being connected through a second horizontal duct (78) with the lower chamber (66), the first horizontal duct (74) being obtained in the cylindrical structure (20) at a lower height than the second horizontal duct (78) obtained in the cylindrical structure (20).

7. A door closing device (10) for an automatic closing of a door leaf (B) coupled with a floor or a doorpost (S) so as to swing, characterized in that door closing device comprises:

a fixed unit (12) that is fixed on the floor or the doorpost (S);

a translating unit (14) that is coupled with the fixed unit (12) so as to translate and comprises a first spring (38) and at least a wheel (44) connected with the translating unit so as to rotate, the axis of rotation of said wheel (44) being perpendicular to the direction of translation of the translating unit (14);

a rotating unit (16) on which the door leaf (B) is fixed and comprises a fixed element (60) that is integral with the rotating unit, and at least a body (51) having an inclined surface (52) in respect to the direction of translation of the translating unit (14); said rotating unit (16) is coupled with the translating unit (14) so that the wheel (44) can run along the inclined surface (52) of the body (51) and on rotating in a first sense of rotation the rotating unit (16) the running of the wheel (44) causes a translation of the translating unit (14) and a compression of the first spring (38) against the fixed element (60); an expansion of said first spring (38) causes a reverse rotation in respect to the first sense of rotation of the rotating unit (16) and door leaf fixed thereon;

wherein the rotating unit (16) comprises a first cam (54) having an inclined surface and fixed on the body (51), a through-hole (58, 59) being obtained in said body (51), and wherein the translating unit (14) comprises a pin (30) which passes through the through-hole (58, 59) and with which the wheel (44) is connected so as to rotate; a second cam (40) having an inclined surface is fixed on said pin (30), the direction of inclination of said second cam being the same as the one of the first cam (54), so that the inclined surface of the first cam (54) can beat against the inclined surface of the second cam (40);

wherein a hollow cylindrical structure (20), closed on the upper and lower parts, is fixed on the rotating unit (16), in which cylindrical structure (20) the translating unit (14) can translate and with which the fixed unit (12) is coupled so as to rotate, and a translating piston (46) is arranged in said cylindrical structure (20) so that the inner volume of the cylindrical structure (20) is divided into a lower chamber (66) and an upper chamber (68) for the containment of a fluid; at least a duct (72, 74, 76, 78, 84, 86) is obtained in said piston or cylindrical structure (20) for the exchange of fluid between the lower chamber (66) and the upper chamber (68); and said piston (46) is coupled with said translating unit (14) so that a translation of the translating unit (14) causes a corresponding translation of the piston (46); and wherein on the upper part, the piston (46) is connected through a second spring (48) with the upper end of the cylindrical structure (20) and on the lower part, the piston (46) beats against the upper end of the pin (30).

* * * * *